US008182873B2

(12) United States Patent
Imori et al.

(10) Patent No.: US 8,182,873 B2
(45) Date of Patent: May 22, 2012

(54) METHOD FOR ELECTROLESS PLATING AND METAL-PLATED ARTICLE

(75) Inventors: Toru Imori, Kitaibaraki (JP); Junnosuke Sekiguchi, Kitaibaraki (JP); Atsushi Yabe, Kitaibaraki (JP); Yoshihisa Fujihira, Takatsuki (JP)

(73) Assignee: Nippon Mining & Metals Co., Ltd., Minato-ku, Tokyo (JP)

( * ) Notice: Subject to any disclaimer, the term of this patent is extended or adjusted under 35 U.S.C. 154(b) by 1389 days.

(21) Appl. No.: 10/558,172

(22) PCT Filed: Mar. 31, 2004

(86) PCT No.: PCT/JP2004/004674

§ 371 (c)(1), (2), (4) Date: Nov. 22, 2005

(87) PCT Pub. No.: WO2004/108986

PCT Pub. Date: Dec. 16, 2004

(65) Prior Publication Data

US 2006/0233963 A1 Oct. 19, 2006

(30) Foreign Application Priority Data

Jun. 9, 2003 (JP) ..... 2003-163105

(51) Int. Cl.

| | |
|---|---|
| ***C23C 18/18*** | (2006.01) |
| ***B05D 1/38*** | (2006.01) |
| ***B05D 3/02*** | (2006.01) |
| ***B05D 3/10*** | (2006.01) |

(52) U.S. Cl. ..... 427/304

(58) Field of Classification Search ..... 427/304
See application file for complete search history.

(56) References Cited

U.S. PATENT DOCUMENTS

| | | | | |
|---|---|---|---|---|
| 6,344,309 | B2 * | 2/2002 | Fukushima et al. | 430/324 |
| 6,780,467 | B2 * | 8/2004 | Imori | 427/304 |
| 7,045,461 | B2 * | 5/2006 | Imori et al. | 438/678 |
| 7,179,741 | B2 * | 2/2007 | Imori et al. | 438/675 |
| 2002/0192379 | A1 * | 12/2002 | Imori | 427/304 |
| 2003/0008075 | A1 * | 1/2003 | Ueno et al. | 427/304 |
| 2007/0120880 | A1 * | 5/2007 | Kawamura et al. | 347/1 |
| 2008/0014362 | A1 * | 1/2008 | Kawamura et al. | 427/443.1 |

FOREIGN PATENT DOCUMENTS

| | | |
|---|---|---|
| JP | 61-138254 | 6/1986 |
| JP | 63-227784 | 9/1988 |
| JP | 5-287543 | 11/1993 |

(Continued)

*Primary Examiner* — Katherine A Bareford
(74) *Attorney, Agent, or Firm* — Flynn, Thiel, Boutell & Tanis, P.C.

(57) ABSTRACT

A method for metal plating with good adhesion to materials that are difficult to plate wherein a material to be plated is surface-treated with a silane coupling agent having in a molecule thereof a functional group with a metal-capturing capability, is heat treated at a high temperature of at least 150° C. in air or an inert gas atmosphere, surface treatment is performed with a solution containing a noble metal compound, and electroless plating is performed. Alternatively, a metal plating method is provided wherein a material to be plated is surface-treated with a liquid in which a noble metal compound and a silane coupling agent having in a molecule thereof a functional group with a metal-capturing capability have already been mixed or reacted, is heat treated at a high temperature of at least 150° C. in air or an inert gas atmosphere, and electroless plating is performed.

14 Claims, 1 Drawing Sheet

MEASURING CONDITIONS: NITROGEN ATMOSPHERE, RATE OF TEMPERATURE RISE 5°C/min

FOREIGN PATENT DOCUMENTS

| | | | |
|---|---|---|---|
| JP | 6-29246 | | 2/1994 |
| JP | 7-102380 | | 4/1995 |
| JP | 8-39728 | | 2/1996 |
| JP | 9-263950 | | 10/1997 |
| JP | 2000-163743 | | 6/2000 |
| JP | 2000-204479 | * | 7/2000 |
| JP | 2000-319541 | | 11/2000 |
| JP | 2001-295058 | | 10/2001 |
| JP | 3277463 | * | 4/2002 |
| JP | 2002-226972 | | 8/2002 |
| JP | 2003-013241 | * | 1/2003 |
| JP | 2003-13241 | | 1/2003 |
| JP | 2003-41374 | | 2/2003 |
| WO | WO 01/49898 A1 | | 7/2001 |
| WO | WO 01/81652 A1 | | 11/2001 |

* cited by examiner

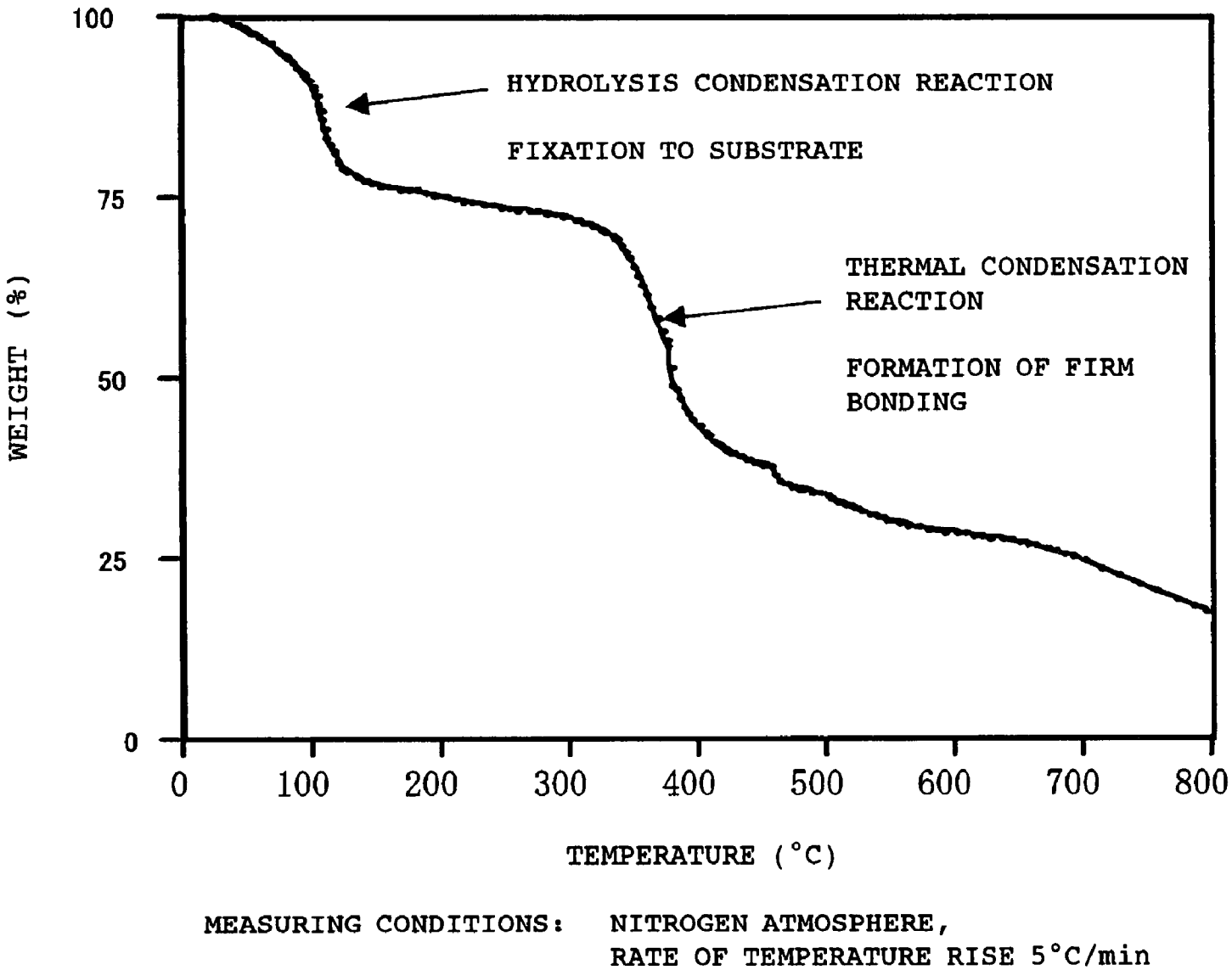
HYDROLYSIS CONDENSATION REACTION
FIXATION TO SUBSTRATE
THERMAL CONDENSATION REACTION
FORMATION OF FIRM BONDING
WEIGHT (%)
100
75
50
25
0
0
100
200
300
400
500
600
700
800
TEMPERATURE (°C)
MEASURING CONDITIONS: NITROGEN ATMOSPHERE, RATE OF TEMPERATURE RISE 5°C/min

METHOD FOR ELECTROLESS PLATING AND METAL-PLATED ARTICLE

TECHNICAL FIELD

This invention relates to a method for the electroless plating of materials that are difficult to plate, with which an electroless plating film tends to exhibit poor adhesion.

BACKGROUND ART

The metal plating of objects is an important technology in the mounting of electrical and electronic parts, and development has been underway on this front. However, metal plating a difficult-to-plate object such as a mirror-finished object with low conductivity, typified by a semiconductor wafer, still poses technological difficulties, and many different methods have been devised to this end. These methods include one involving a pretreatment in which a silane coupling agent is used on the object to be plated, that is, a silane coupling agent is interposed between the object to be plated and the metal plating film.

The method disclosed in Japanese Patent Publication 7-102380A is an example of interposing a silane coupling agent between the object to be plated and the metal plating film so as to obtain good adhesion. The treatment method disclosed in this document, however, uses a silane coupling agent along with a urethane resin, the silane coupling agent firmly bonds with both the urethane resin and the glass fiber that is the material to be plated, and the urethane resin thus bonded to the glass fiber improves the adhesion of the metal electroless plating film. Also, Japanese Patent Publication 7-102380A states that the object to be plated is treated with the silane coupling agent along with the urethane resin, dried, and then heat treated for 5 minutes at 120° C., and the purpose of this heat treatment is to ensure the bonding of the silane coupling agent to the surface of the object being plated, and the bonding reaction between the urethane resin and the silane coupling agent.

Also, it is stated in Japanese Patent Publication 8-39728A that when the drying temperature is over 150° C. following the surface treatment of the plating object with a silane coupling agent, the silane coupling agent evaporates along with the solvent in the silane coupling agent solution, so there is a variance in the thickness of the silane coupling agent layer. The usual procedure up to now has been to coat with a silane coupling agent, then affix the silane coupling agent to the plating object, so the drying temperature has been 150° C. or under.

In addition, there have been proposed a method involving the use of a pretreatment agent comprising a combination of a special silane coupling agent and a noble metal compound (see the pamphlet of International Patent Publication 01-49898); a method in which the plating object is treated with a pretreatment agent to which a special silane coupling agent and a reducing agent are sequentially added (see the pamphlet of International Patent Publication 01/81652); a method in which the plating object is sequentially treated with a solution containing an alkali metal salt and a special silane coupling agent (see Japanese Patent Publication 2002-226972A); and a pretreatment liquid containing specific proportions of a special silane coupling agent and a noble metal compound (see Japanese Patent Publication 2003-13241A). This prior art is effective in terms of metal-plating materials that are difficult to plate, but in every case the temperature is about 60 to 120° C. in order to dry off the solvent after the silane coupling agent has been applied to the plating object, and no particular study has gone into the heat treatment.

Patent Document 1: Japanese Patent Publication 7-102380A

Patent Document 2: Japanese Patent Publication 8-39728A

Patent Document 3: International Patent Publication 01-49898 pamphlet

Patent Document 4: International Patent Publication 01-81652 pamphlet

Patent Document 5: Japanese Patent Publication 2002-226972A

Patent Document 6: Japanese Patent Publication 2003-13241A

DISCLOSURE OF THE INVENTION

It is an object of the present invention to provide a method for metal plating with better adhesive strength on materials with low conductivity and materials that are difficult to plate, such as mirror-finished materials, powders, resin fabrics, and so forth.

As a result of research particularly focused on the effect that temperature has on a surface treatment, the inventors arrived at the following present inventions.

Specifically, a first embodiment of the present invention is a metal plating method wherein a material to be plated is surface treated with a silane coupling agent having in a molecule thereof a functional group with a metal-capturing capability, the material to be plated is heat treated at a high temperature of at least 150° in air or an inert gas atmosphere, a surface treatment is performed with a solution containing a noble metal compound, and electroless plating is performed.

A second embodiment of the present invention is a metal plating method wherein a material to be plated is surface treated with a liquid in which a noble metal compound and a silane coupling agent having in a molecule thereof a functional group with a metal-capturing capability have already been mixed or reacted, the material to be plated is heat treated at a high temperature of at least 150° C. in air or an inert gas atmosphere, and electroless plating is performed.

The inventors focused in particular on the structural changes produced by the heating of a silane coupling agent interposed between a plating object and a metal plating film.

BRIEF DESCRIPTION OF THE DRAWINGS

FIG. 1 is a graph of thermal weight loss data for the silane coupling agent used in the present invention. More specifically, it shows data for thermal weight loss (TGA) of a silane coupling agent that is the equimolar reaction product of γ-glycidoxypropyltrimethoxysilane and imidazole, which is a silane coupling agent obtained by reacting an azole compound with an epoxysilane compound. It can be seen from the obtained data that the silane coupling agent undergoes a structural change based on pyrolysis. An investigation into this revealed that heat treatment at 150° C. or higher after coating with the silane coupling agent has a significant effect on increasing the adhesion of an electroless plating film when a coupling agent is interposed. It is believed that the silane coupling agent undergoes pyrolysis and vitrifies, and that this is why such firm adhesion is obtained.

BEST MODE FOR CARRYING OUT THE INVENTION

With the method of the present invention, the optimal heat treatment temperature will vary with the type of coupling agent, but usually must be at least 150° C. When the silane coupling agent is obtained by reacting an azole compound and an epoxysilane compound, which is particularly favorable as the silane coupling agent used in the present invention, structural change as a result of pyrolysis begins when the temperature climbs over 150° C., as shown in FIG. 1, and a particularly great structural change occurs at 250° C. and above. Therefore, the heat treatment temperature in the present invention is preferably at least 200° C., and especially at least 250° C.

The atmosphere in which the heat treatment is carried out preferably consists of an inert gas such as nitrogen, but if the object being plated has a high heat resistance, an oxygen atmosphere may also be used. Although the temperature here must be at least 200° C., it must also be one at which the plating object will not be damaged by heat. The heat treatment duration is preferably from 3 to 60 minutes.

The silane coupling agent having in its molecule a functional group with a metal-capturing capability that is used in the present invention will now be described.

Although not a comprehensive listing, examples of functional groups having a metal-capturing capability that are useful in the present invention include an amino group, carboxyl group, azole group, hydroxyl group, and mercapto group. Of these, an azole group is particularly favorable.

Examples of azole groups include an imidazole group, oxazole group, thiazole group, selenazole group, pyrazole group, isoxazole group, isothiazole group, triazole group, oxadiazole group, thiadiazole group, tetrazole group, oxatriazole group, thiatriazole group, bendazole group, indazole group, benzimidazole group, and benzotriazole group. Of these, an imidazole group is particularly favorable.

The silane coupling agent used in the present invention is a compound having an $—SiX_1X_2X_3$ group in addition to the above-mentioned functional group having a metal-capturing capability. $X_1$, $X_2$, and $X_3$ are each an alkyl group, halogen, alkoxy group, or the like, and are a functional group that can be fixed to the object being plated. $X_1$, $X_2$, and $X_3$ may be the same or different. Preferred examples include silane coupling agents obtained by reacting an azole compound with an epoxysilane compound.

The epoxysilane compound (a silane compound containing an epoxy group) that is reacted with the azole compound is preferably an epoxysilane coupling agent expressed by the following formula. In the formula, $R^1$ and $R^2$ are each a hydrogen or a $C_1$ to $C_3$ alkyl group, and n is a number from 0 to 3.

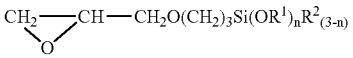

The reaction between the azole compound and the above-mentioned epoxy group-containing silane compound can be conducted under the conditions discussed in Japanese Patent Publication 6-256358A. For example, 0.1 to 10 mol of an epoxy group-containing silane compound is added dropwise to 1 mol of an azole compound at 80 to 200° C. and allowed to react for from 5 minutes to 2 hours. There is no particular need for a solvent here, but chloroform, dioxane, methanol, ethanol, or another such organic solvent may be used.

A silane coupling agent that is especially favorable for use in the present invention is the product of reacting an imidazole compound and an epoxysilane compound. These two are reacted as shown in the following formula, where $R^1$ and $R^2$ are each a hydrogen or a $C_1$ to $C_3$ alkyl group, $R^3$ is a hydrogen or a $C_1$ to $C_{20}$ alkyl group, $R^4$ is a vinyl group or a $C_1$ to $C_5$ alkyl group, and n is a number from 0 to 3.

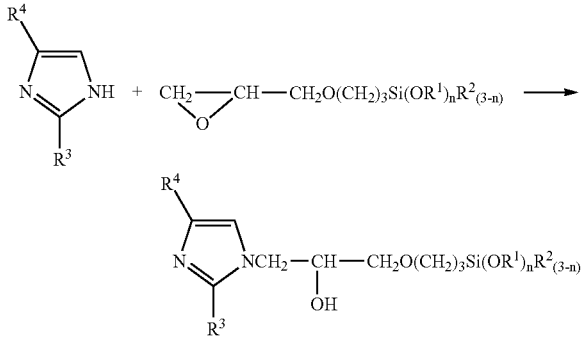

Other examples of the silane coupling agent used in the present invention include γ-aminopropyltrimethoxysilane, γ-aminopropyltriethoxysilane, N-β(aminoethyl) γ-aminopropyltrimethoxysilane, N-β(aminoethyl) γ-aminopropyltriethoxysilane, and γ-mercaptopropyltrimethoxysilane.

Examples of noble metal compounds include chlorides, hydroxides, oxides, sulfates, ammine complexes such as ammonium salts, and so forth of palladium, silver, platinum, gold, and the like, which exhibit a catalytic effect in precipitating copper, nickel, or the like on the surface of a plating object from an electroless plating solution. Palladium chloride and silver nitrate are particularly favorable. It is preferable to use the noble metal compound in the form of a solution, and especially an aqueous solution, and the concentration in the solution is preferably from 10 to 300 mg/L. Examples of solvents other than water that can be used include methanol, ethanol, butanol, isopropyl alcohol, methyl ethyl ketone, and ethyl acetate.

In a first embodiment of the present invention, the object to be plated is first surface treated with the above-mentioned silane coupling agent. Examples of the solvent here include methanol, ethanol, butanol, and isopropyl alcohol. The plating object is then heat treated at a high temperature of at least 150° C. The end result of this heat treatment is that, as discussed above, strong adhesion is obtained between the plating object and the metal plating film with the silane coupling agent interposed therebetween. After the heat treatment step, the plating object is further surface treated with a solution containing a noble metal compound, after which a metal plating film is formed by electroless plating.

In a second embodiment of the present invention, meanwhile, a solution obtained ahead of time by mixing or reacting a solution containing a noble metal compound and the above-mentioned silane coupling agent is readied as a pretreatment agent, and the plating object is surface treated with this solution. After this, a heat treatment is performed at a high temperature of at least 150° C., the end result of which is again that strong adhesion is obtained between the plating object and the metal plating film. After the heat treatment step, electroless plating is performed on the plating object.

Just as in the first embodiment, one of the following suitable solvents can be used in the solution in which the above-mentioned silane coupling agent and noble metal compound are mixed or reacted ahead of time. These solvents include water, methanol, ethanol, 2-propanol, acetone, toluene, ethylene glycol, polyethylene glycol, dimethylformamide, dimethyl sulfoxide, dioxane, and so forth, as well as mixtures of these.

In the first and second embodiments, it is preferable for the concentration of the silane coupling agent to be from 0.001 to 10 wt % in the surface treatment. Below 0.001 wt %, very little of the compound will adhere to the surface of the substrate and the effect will tend to be minimal. If 10 wt % is exceeded, though, too much of the compound will adhere, making it harder to dry and making it more likely that powder clumping will occur.

When the surface treatment is performed on a substrate in the form of a fabric or a sheet, it is generally accomplished by dipping, brushing, or another such method, after which the solvent is evaporated off. These are not the only methods that can be used, however, and any method that allows the silane coupling agent to be uniformly applied over the surface can be employed. The method used for a powder is to evaporate the solvent after a dipping treatment, so that the silane coupling agent contained in the solution is forcibly made to adhere to the substrate surface. In addition, because this silane coupling agent is good at forming a uniform film, adsorption to the substrate surface through a dipping treatment is possible, which means that another possible method is to filter off the solvent after the treatment and dry the wet powder. In these cases, the above-mentioned heat treatment is performed either after or continuously during the drying.

The object to be plated may be washed prior to the plating pretreatment. When particularly good adhesion is required, a conventional etching treatment with chromic acid or the like may also be performed.

With the metal plating method of the present invention, electroless plating is performed after the above-mentioned surface treatment and heat treatment. At this stage the plating object can be plated with copper, nickel, cobalt, tin, gold, or another such metal. Surprisingly, if the noble metal is captured by the silane coupling agent and a heat treatment then performed at 150° C. or higher, electroless plating can be performed without including a reduction step. Naturally, there will be times when it is effective to use a reducing agent such as dimethylamine borane or a sodium hypophosphite solution after the heat treatment. It is also possible to perform electroplating or substitution-type plating with a base metal after first performing electroless plating to form a metal thin film and imparting a certain amount of conductivity to a non-conductive substrate.

Examples of the material to be plated include semiconductor wafers of silicon, indium-phosphorus, gallium-boron, or the like, glass, polyaramid, polyimide, liquid crystal polymers, and other such resins, alumina and other such ceramics, and other materials considered difficult to plate. Naturally, the method of the present invention can be applied to any material that has sufficient heat resistance, and electroless plating can be performed favorably.

EXAMPLES

The present invention will now be described in specific terms through reference to examples and comparative examples, but the present invention is not limited to or by the following examples. In these examples and comparative examples, electroless plating was performed by the following method. The plating film thickness was measured by cleaving the plated object and observing the cross-section by SEM.

Example 1

A plating pretreatment agent was prepared by adding palladium chloride to an aqueous solution containing 0.1 wt % of a silane coupling agent that was the equimolar reaction product of γ-glycidoxypropyltrimethoxysilane and imidazole, so that the palladium concentration would be 90 mg/L at room temperature. A silicon wafer that had been sputtered with TaN in a film thickness of 15 nm was immersed in this liquid for 10 minutes at 60° C., then rinsed with running water, after which a heat treatment was performed for 20 minutes at 290° C. in the air. After the wafer had cooled to room temperature, it was immersed in a 10% sulfuric acid aqueous solution, rinsed with water, and then plated for 15 minutes at 60° C. using an electroless copper plating solution.

This product was examined, which revealed that the copper had plated the entire surface of the silicon wafer. The thickness of the copper plating film was 100 nm. The adhesion of the copper film was tested by a tape peel test, but none of the copper was peeled off by the tape, meaning the adhesion was good. This tape peel test was conducted by sticking adhesive tape (Nichiban Cellotape CT-18™) to the plating surface, taking care that no air was trapped, rubbing the top of the tape five times with a pencil eraser, then quickly pulling off the tape and seeing how much of the plating came off.

Example 2

A methanol solution was prepared that contained 0.02 wt % of a silane coupling agent that was the equimolar reaction product of γ-glycidoxypropyltrimethoxysilane and imidazole. A silicon wafer that had been sputtered with TaN in a film thickness of 15 nm was immersed in this liquid for 10 minutes at room temperature, after which a heat treatment was performed for 30 minutes at 350° C. in a nitrogen atmosphere. After this, the silicon wafer was cooled to room temperature, then immersed for another 10 minutes at 60° C. in a palladium chloride aqueous solution with a palladium concentration of 150 mg/L. This silicon wafer was rinsed with running water, and then plated for 15 minutes at 60° C. using an electroless copper plating solution.

This product was examined, which revealed that the copper had plated the entire surface of the silicon wafer. The thickness of the copper plating film was 100 nm. The adhesion of the copper film was tested by the same tape peel test as in Example 1, which revealed the adhesion to be good.

Example 3

A plating pretreatment agent was prepared by adding palladium chloride to an aqueous solution containing 0.1 wt % of a silane coupling agent that was the equimolar reaction product of γ-glycidoxypropyltrimethoxysilane and imidazole, so that the palladium concentration would be 15 mg/L at room temperature. Aramid resin fiber was immersed in this liquid for 10 minutes at 60° C., then rinsed with running water, after which a heat treatment was performed for 20 minutes at 150° C. in a nitrogen atmosphere. After this resin fiber had cooled to room temperature, it was immersed in a 10% sulfuric acid aqueous solution, rinsed with water, and then plated for 15 minutes at 60° C. using an electroless copper plating solution.

This product was examined, which revealed that the copper had plated the entire surface. The Cu content of the plated object was 15.1%. The Cu content was measured from the weight change before and after plating. The adhesion of the copper film was tested by the same tape peel test as in Example 1, which revealed the adhesion to be good.

Example 4

A plating pretreatment agent was prepared by adding palladium chloride to an aqueous solution containing 0.1 wt % of a silane coupling agent that was the equimolar reaction product of γ-glycidoxypropyltrimethoxysilane and imidazole, so that the palladium concentration would be 100 mg/L at room temperature. Aramid resin fiber was immersed in this liquid for 10 minutes at 60° C., then rinsed with running water, after which a heat treatment was performed for 1 hour at 200° C. in a nitrogen atmosphere. After this aramid resin fiber had cooled to room temperature, it was then plated for 15 minutes at 60° C. using an electroless copper plating solution. This product was examined, which revealed that the copper had plated the entire surface. The Cu content of the plated object was found in the same manner as in Example 3 to be 14.8%. Also, the adhesion of the copper film was tested by the same tape peel test as in Example 1, but none of the copper was peeled off by the tape, meaning the adhesion was good.

Comparative Example 1

Other than performing the heat treatment for 20 minutes at 130° C., a silicon wafer that had been sputtered with TaN in a film thickness of 15 nm was subjected to the same series of processes as in Example 1. As a result, the entire surface was placed with copper, and the thickness of the copper plating film thus obtained was 100 nm. However, the same tape peel test as in Example 1 revealed the adhesion to be poor, and the plating came off under powerful rinsing with water.

Comparative Example 2

A plating pretreatment agent was prepared by adding palladium chloride to an aqueous solution containing 0.1 wt % of a silane coupling agent that was the equimolar reaction product of γ-glycidoxypropyltrimethoxysilane and imidazole, so that the palladium concentration would be 15 mg/L at room temperature. Aramid resin fiber was immersed in this liquid for 10 minutes at 60° C., then rinsed with running water, after which plating was performed for 15 minutes at 60° C. using an electroless copper plating solution.

This product was examined, which revealed that the copper had plated the entire surface. The Cu content of the plated object was found in the same manner as in Example 3 to be 14.4%. The adhesion of the copper film was tested by the same tape peel test as in Example 1, which revealed the adhesion to be poor, with copper sticking to the tape.

INDUSTRIAL APPLICABILITY

Using the method of the present invention makes it possible to metal plate with good adhesion on materials that up to now have been considered difficult to plate because of an inadequate adhesive strength between the object being plated and the metal plating film.

The invention claimed is:

1. An electroless metal plating method, comprising the steps of:

reacting an azole compound with an epoxy silane compound to form a silane coupling agent having, in a molecule thereof, a functional group with a metal-capturing capability;

forming a surface-treatment liquid consisting of the silane coupling agent and a solvent and surface-treating a material with the surface-treatment liquid to obtain a surface-treated material;

heat-treating the surface-treated material at a temperature of at least 200° C. in air or an inert gas atmosphere so as to cause a structural change of the silane coupling agent and vitrification thereof to form a heat-treated material;

contacting the heat-treated material with a solution consisting of a noble metal compound and a solvent, and then performing electroless plating on the heat-treated material to form a plated material.

2. The metal plating method according to claim 1, wherein the functional group with a metal-capturing capability is an imidazole group.

3. The metal plating method according to claim 1, wherein the noble metal compound is a palladium compound or a silver compound.

4. The metal plating method according to claim 1, wherein the heat-treating step is carried out at a temperature of at least 250° C.

5. The metal plating method according to claim 1, wherein the heat-treating step is carried out for 3 to 60 minutes.

6. An electroless metal plating method, comprising the steps of:

reacting an azole compound with an epoxy silane compound to form a silane coupling agent having, in a molecule thereof, a functional group with a metal-capturing capability;

mixing or reacting the silane coupling agent with a noble metal compound to form a surface-treatment liquid consisting of the silane coupling agent, the noble metal compound and a solvent;

surface-treating a material with the surface-treatment liquid to form a surface-treated material;

heat-treating the surface-treated material at a temperature of at least 200° C. in air or an inert gas atmosphere so as to cause a structural change of the silane coupling agent and vitrification thereof to form a heat-treated material; and then performing electroless plating on the heat-treated material to form a plated material.

7. The metal plating method according to claim 6, wherein the functional group with a metal-capturing capability is an imidazole group.

8. The metal plating method according to claim 6, wherein the noble metal compound is a palladium compound or a silver compound.

9. The metal plating method according to claim 6, wherein the heat-treating step is carried out at a temperature of at lest 250° C.

10. The metal plating method according to claim 6, wherein the heat-treating step is carried out for 3 to 60 minutes.

11. An electroless metal plating method, comprising the steps of:

reacting an azole compound with an epoxy silane compound to form a silane coupling agent having, in a molecule thereof, a functional group with a metal-capturing capability;

forming a surface-treatment liquid consisting of the silane coupling agent and a solvent and surface-treating a material with the surface-treatment liquid to obtain a surface-treated material;

heat-treating the surface-treated material at a temperature of at least 200° C. in air or an inert gas atmosphere so as to reduce the weight of the silane coupling agent to 75% or less with respect to the weight of the silane coupling agent provided onto the material by the surface-treating to form a heat-treated material;

contacting the heat-treated material with a solution consisting of a noble metal compound and a solvent, and then performing electroless plating on the heat-treated material to form a plated material.

12. The metal plating method according to claim 11, wherein the heat-treating step is carried out for 3 to 60 minutes.

13. An electroless metal plating method, comprising the steps of:

reacting an azole compound with an epoxy silane compound to form a silane coupling agent having, in a molecule thereof, a functional group with a metal-capturing capability;

mixing or reacting the silane coupling agent with a noble metal compound to form a surface-treatment liquid consisting of the silane coupling agent, the noble metal compound and the solvent;

surface-treating a material with the surface-treatment liquid to form a surface-treated material;

heat-treating the surface-treated material at a temperature of at least 200° C. in air or an inert gas atmosphere so as to reduce the weight of the silane coupling agent to 75% or less with respect to the weight of the silane coupling agent provided onto the material by the surface-treating to form a heat-treated material; and then performing electroless plating on the heat-treated material to form a plated material.

14. The metal plating method according to claim 13, wherein the heat-treating step is carried out for 3 to 60 minutes.

* * * * *